United States Patent [19]

Kirchmeyr et al.

[11] 4,166,634

[45] Sep. 4, 1979

[54] ATTACHMENT FOR RELEASE SKI BINDINGS

[75] Inventors: Gustav Kirchmeyr, Innsbruck; Erwin Weigl, Brunn am Geb; Jaroslav Knotek; Tibor Szasz, both of Vienna, all of Austria

[73] Assignee: TMC Corporation, Baar, Switzerland

[21] Appl. No.: 784,440

[22] Filed: Apr. 4, 1977

[30] Foreign Application Priority Data

Apr. 7, 1976 [AT] Austria ..... 2481/76

[51] Int. Cl.[2] ..... A63C 9/00

[52] U.S. Cl. ..... 280/614; 280/11.37 E; 280/618

[58] Field of Search ..... 280/614, 618, 615, 11.37 E, 280/601

[56] References Cited

U.S. PATENT DOCUMENTS

| | | | |
|---|---|---|---|
| 3,877,712 | 4/1975 | Weckeiser | 280/614 |
| 3,964,756 | 6/1976 | Mory | 280/618 |
| 4,018,456 | 4/1977 | Gertsch | 280/618 |

FOREIGN PATENT DOCUMENTS

| | | | |
|---|---|---|---|
| 2307427 | 12/1973 | Fed. Rep. of Germany | 280/614 |
| 2327076 | 12/1974 | Fed. Rep. of Germany | 280/614 |
| 470189 | 5/1969 | Switzerland | 280/614 |
| 564357 | 7/1975 | Switzerland | 280/614 |

*Primary Examiner*—David M. Mitchell

*Attorney, Agent, or Firm*—Blanchard, Flynn, Thiel, Boutell & Tanis

[57] ABSTRACT

An improvement in an attachment for release ski bindings enabling the skier to selectively decide the mode of skiing, namely downhill skiing or cross-country skiing. The attachment includes a sole plate which holds the ski boot onto the ski. The sole plate has a connecting piece fixedly connected thereto and is pivotally secured to a ski binding element about an axis extending transverse of the longitudinal axis of the ski. The connection between the sole plate and the ski binding element is a releasable connection to facilitate the skier's selection of the mode of skiing.

8 Claims, 10 Drawing Figures

ATTACHMENT FOR RELEASE SKI BINDINGS

FIELD OF THE INVENTION

The invention relates to an attachment for release ski bindings for cross-country skiing comprising a sole plate which holds the ski boot on the ski and on which sole plate the ski boot is releasably secured by releasable holding elements and is held lockably between the sole plate and a ski binding part by means of a connecting piece.

BACKGROUND OF THE INVENTION

An attachment of the abovementioned type is for example described in Swiss Pat. No. 504 216. In this known construction, the connecting piece consists of two hinge parts which can engage one another, of which hinge parts the one part can be released from its active position of being in engagement with the other part and can be moved into an inactive position in which the boot plate cooperates with the locking mechanism. The one hinge part is thereby fixedly arranged on the boot plate and the other hinge part is releasably arranged on the ski. The hinge part which can be connected to the ski is designed substantially as a tongue or tab which extends in longitudinal direction of the ski and carries on the end adjacent to the tip of the boot two upstanding fins to which a pivot pin is secured and engage open holding eyelets which are provided on the other hinge part. For downhill skiing, the hinge part which is only releasably connected to the ski is removed and the boot plate is received in the usual manner by the ski binding parts which are secured on the ski and which can effect a safety release.

A disadvantage of this known construction consists in the pivot axis which is needed for cross-country skiing lying in front of the tip of the boot and approximately in the upper area of the sole of the boot. This "front connection" leads to early fatigue because the entire weight must be absorbed by the screw which holds the hinge part connected to the boot plate. Finally the hinge part which is releasably connected to the ski must be stored separately during downhill skiing. The hinge part which during downhill skiing extends forwardly and is secured on the sole plate means, in the case of a fall, an additional risk for injury and can itself also be easily damaged.

Also a device is known (Swiss Pat. No. 513 659) in which a sole plate is suited for both cross-country skiing and also downhill skiing. The pivot axis of this known device lies also in front of the tip of the boot and in the upper area of the front holding mechanism so that the earlier mentioned fatigue appearances also occur.

In a different known attachment for the downhill skiing and cross-country skiing according to German OS No. 2 231 058, the ski boot lies, by the interpositioning of a sole plate, between parts of a release ski binding. The boot is held by means of a transverse axle which is defined by a through bolt and extends through a transverse opening in the sole of the boot adjacent the toe thereof. At the rear part of the plate there is provided a swingable snap mechanism which for downhill skiing presses the heel on the plate and releases same for cross-country skiing.

A disadvantage of this device consists in the sole of the boot having an opening therein which serves as a pivot axis and has to be equipped with a separate holding mechanism. Thus common ski boots which are available on the market are not suited for the use of this sole plate. A further disadvantage consists in the holding bolts are required to be guided in or out during every stepping in and out and still an additional lock is required for use thereof. A separate storage of the lock is needed during periods of nonuse. A still further disadvantage consists in a certain play or clearance provided between the opening and the transverse axis for cross-country skiing and this play is disadvantageous for downhill skiing. Since the snap part which holds down the heel does not press the boot on the holding axis, the play or clearance which exists between holding bolt and bore has a disadvantageous effect for the guiding of the ski.

Also devices are known in which the pivot axis is loaded by a spring. U.S. Pat. No. 2,450,526 describes a construction having a pressure spring; U.S. Pat. No. 3,388,918 describes a device for cross-country skiing in which the tension is produced by a resilient safety tensioning means.

German Pat. No. 2 307 427 describes a device for securing a ski boot on the ski in two different positions, namely one position for downhill skiing and one position for cross-country skiing or racing. For this purpose, a support part is utilized between ski boot and ski adjacent the rear area of which the heel holding means can be secured in two different positions. For downhill skiing, the ski boot is held between a front ski binding part which is secured on the ski and the heel holding means and, in this case the heel holding means is fixed on a locking mechanism which is secured to the ski. For cross-country skiing or for racing, the ski boot is moved backwardly on the surface of the support part and is fixed to the support part by a front holding element which, in the downhill skiing position, is swung out of active position and wherein the heel holding means rests in a mounting which is provided on the support parts. To adjust the heel holding means, the support part has at the two sides elongated recesses. Moreover, the support part has a U cross section which permits, on the one hand, an adjustment of the holding part of the heel holding means and, on the other hand, the reception of the locking for said holding part. The support part is supported at its front area on a pivot axis which is held on a ski-fixed fastening part.

This known device permits a support of the ski boot for cross-country skiing and for racing in the toe area, however, it has the following disadvantages. For downhill skiing the ski boot is held in an elevated position by the support part, which position is disadvantageous for guiding the ski. The use of the support part for downhill skiing is not related to the advantages of common sole plates because the ski boot is held between ski-fixed parts—namely the front ski binding part and the heel holding means which is suspended in the ski-fixed locking mechanism. In addition, a ski boot having a soft sole cannot be used because the front area of the ski boot lies free. For downhill skiing there exists a disadvantage in that the heel holding means, which in this case must necessarily be a safety release binding, is hauled along during each step and produces a torque which must be considered and is caused by the arm between the heel holding means and the axis of rotation. This torque stresses the limbs of the skier and can result in premature fatigue. Finally it must also be considered that the heel holding means can also be a type of upright piston bindings so that this device cannot be used in connection with other safety ski bindings.

In conclusion it can therefore be stated that in all efforts which are directed to producing a device which is suited simultaneously for downhill skiing and for cross-country skiing, limitations as to comfort and additional manipulations must be accepted.

The purpose of the invention is to aid and to design an attachment for cross-country skiing of the abovementioned type so that same meets all requirements of cross-country skiing without requiring separate ski binding holding parts for downhill skiing. An as large as possible selection of known ski binding parts is to be used.

The set purpose is inventively attained by the connecting piece being permanently connected to the sole plate, as actually known, by an axle which extends transversely with respect to the longitudinal axis of the ski and is capable of being swung upwardly against the force of a spring, wherein the pivot axis, as is acutally also known, is arranged substantially below the toe area and, in addition, the sole plate which is provided with the connecting piece is capable of being removed for downhill skiing and replaceable, if desired, with a common sole plate.

Through the inventive construction of the attachment, a device is provided for cross-country skiing which combines the advantages of all known devices, permits the use of existing ski boots namely both those with a stiff sole and a soft sole, both in the case of ski binding parts which hold sole plates on the skis and those which permit a direct mounting of ski boots on the skis and can be mounted easily on the skis. For downhill skiing, the attachment is also detached in a simple manner and is replaced if necessary with a common sole plate. If ski binding parts are used which receive the ski boot without using a sole plate, then the release ski binding is ready for downhill skiing after removal of the attachment.

BRIEF DESCRIPTION OF THE DRAWINGS

Further advantages and details of the invention result from the following description which will be discussed more in detail with reference to the drawings, which show some exemplary embodiments.

In the drawings:

FIGS. 3 and 4 are each a cross-sectional view of FIG. 2 taken along the lines III—III and IV—IV, wherein FIG. 3 is the position of attachment or detachment and FIG. 4 is the position during cross-country skiing without a holding piston;

FIGS. 7 and 8 are each a cross-sectional view taken along the lines VII—VII and VIII—VIII, wherein FIG. 7 illustrates the locking position and FIG. 8 the attachment or detachment;

DETAILED DESCRIPTION

Figure 1:
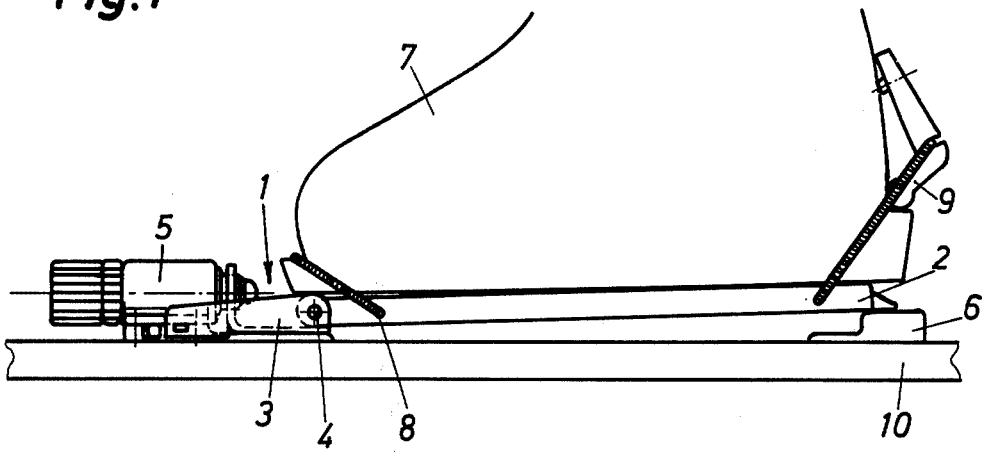
FIG. 1 is a side view of a first exemplary embodiment of the inventive attachment with a ski boot mounted thereon.

In the following description, the same parts have the same reference numerals; parts which have the same purpose but are different are identified with the addition of a prime (') suffix.

In the embodiment according to FIG. 1, an attachment is identified as a whole by reference numeral 1 and consists of a sole plate 2 and a connecting piece 3 which are connected by means of an axle 4 and are held on a ski binding part 5. A further ski binding part 6 is provided at the other end of the sole plate 2 such that between the ski binding parts 5 and 6 a common sole plate (not separately illustrated) can be inserted. In the exemplary embodiment according to FIG. 1, a ski boot 7 is positioned on the surface of the sole plate 2 and is releasably held on same by holding elements 8,9. The ski binding parts 5,6 are secured to a ski 10.

Figure 5:
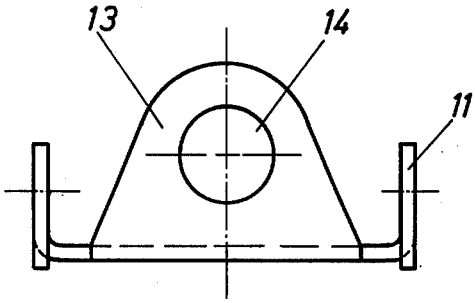
FIG. 5 illustrates a front view of the attachment with the remaining parts omitted therefrom.
Figure 6:
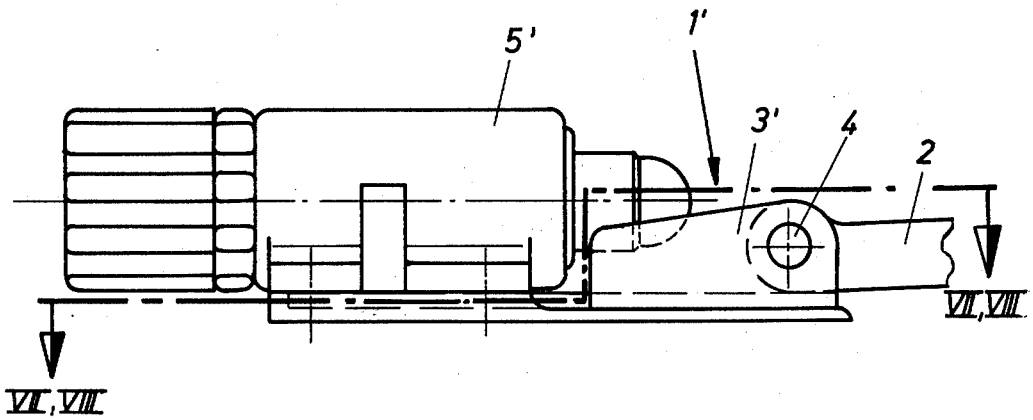
FIG. 6 illustrates the front part similar to FIG. 2, however, for a second exemplary embodiment.
Figure 2:
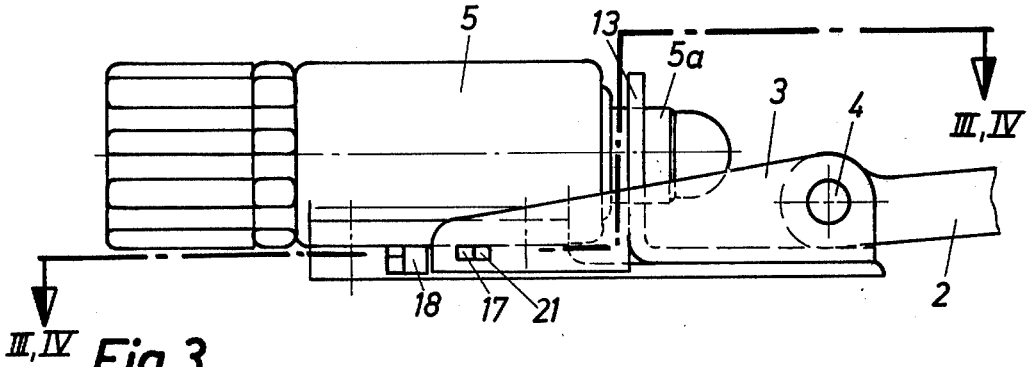
FIG. 2 illustrates in an enlarged scale the front part of FIG. 1.

Details of the embodiment of the connecting piece 3 according to FIG. 1 are illustrated in FIGS. 2 to 5. As can be recognized from these figures, the connecting piece 3 has two lateral holding arms 11 which extend parallel to the longitudinal axis of the ski and have recesses 12 thereon. In addition, the connecting piece has an upwardly projecting flange 13 which functions as a support and engages a pistonlike holding part 5*a* of the ski binding part 5. The flange 13 is for this purpose, as can be recognized from FIG. 5, provided with an opening 14. The diameter of the opening 14 corresponds with the outer diameter of the pistonlike part 5*a* of the ski binding part 5.

Figure 3:
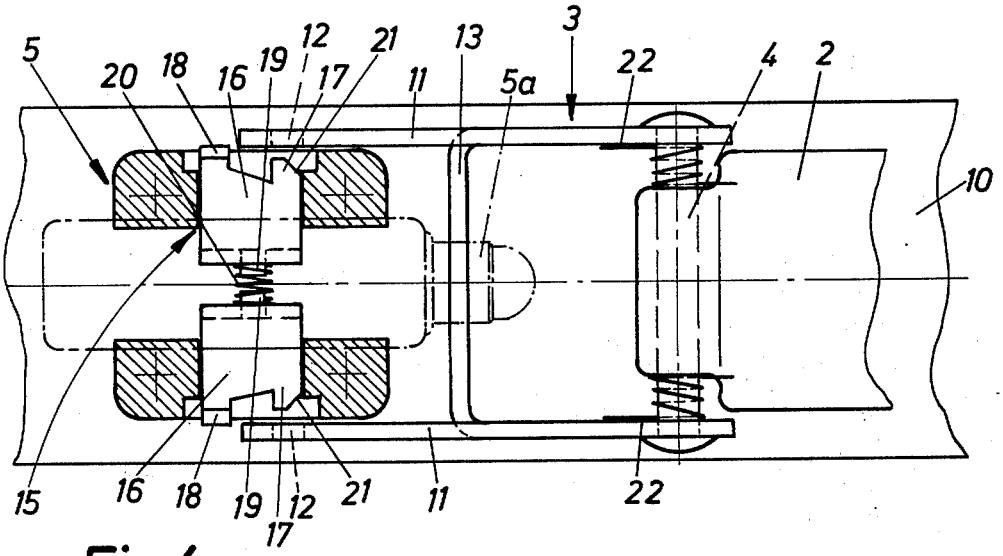
Figure 4:
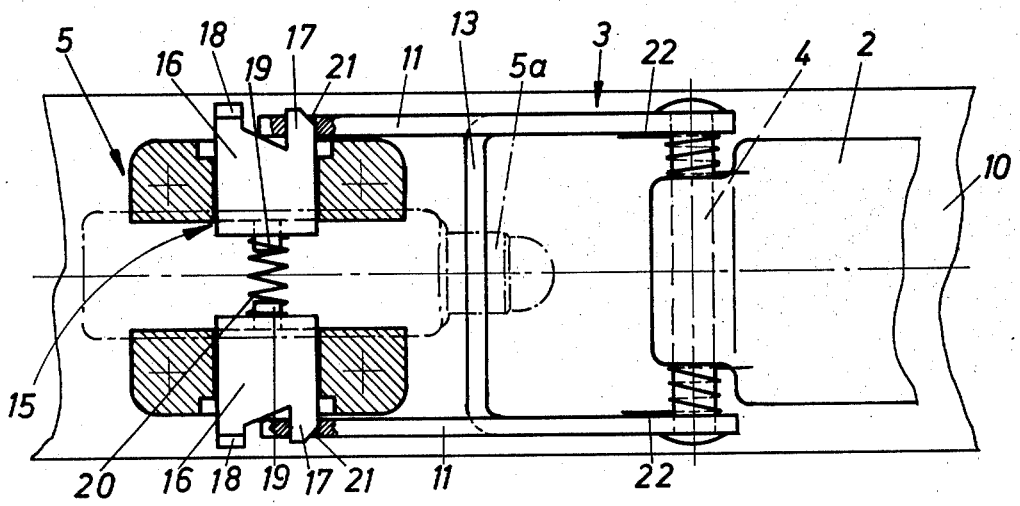
Figure 7:
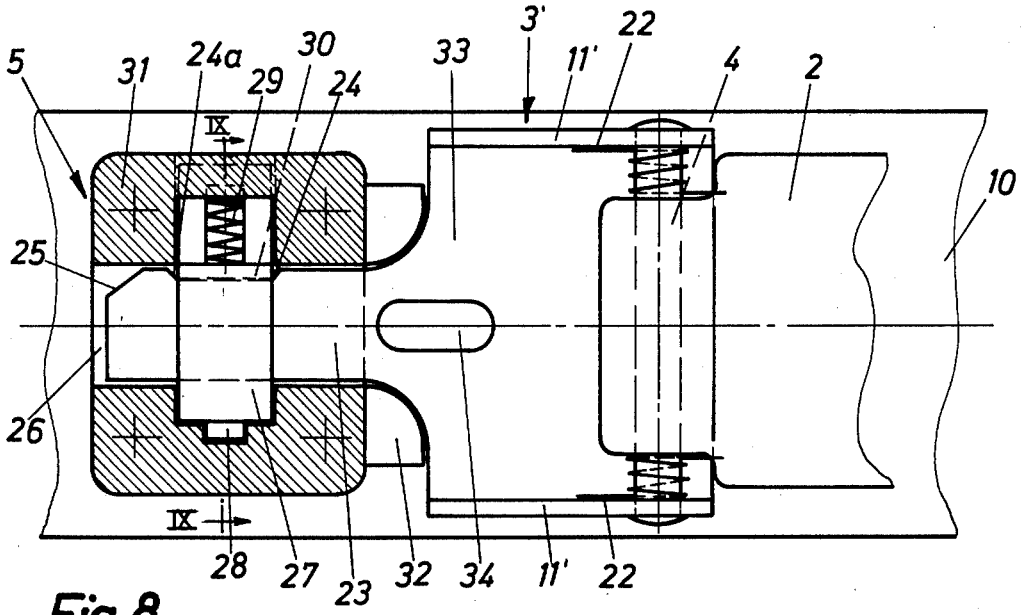
Figure 8:
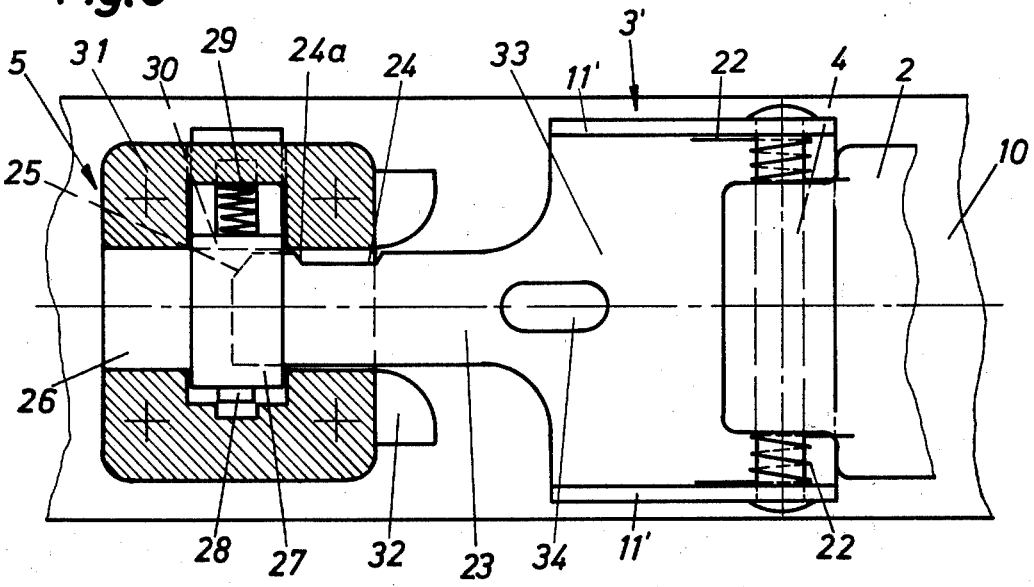
Figure 9:
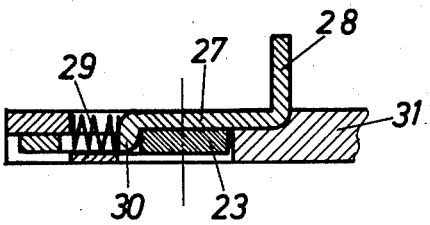
FIG. 9 is a cross-sectional view taken along the line IX—IX of FIG. 7.
Figure 10:
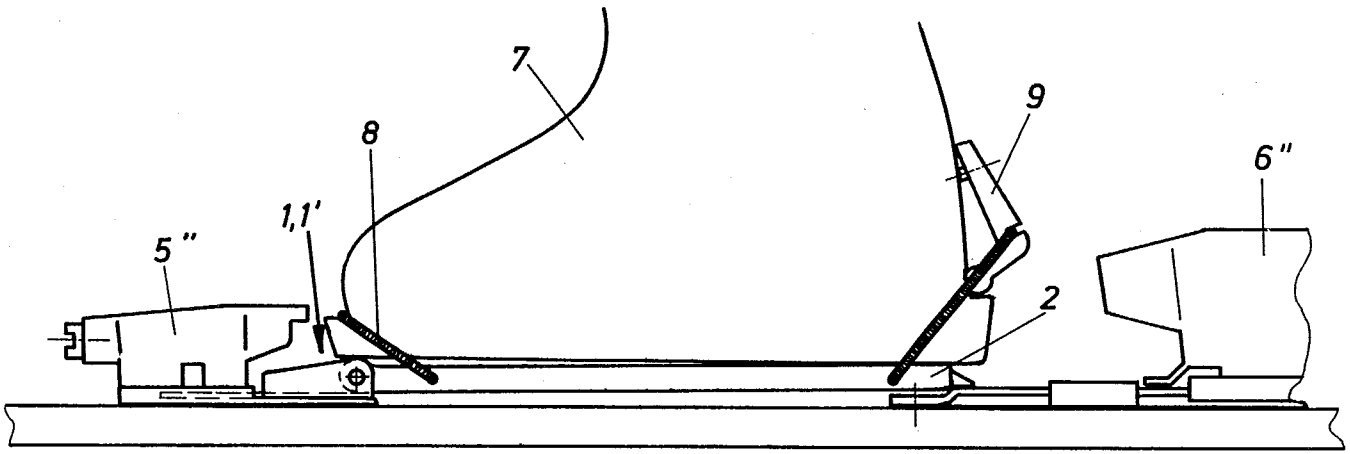
FIG. 10 is a side view of a third exemplary embodiment.

To secure the connecting piece 3 on the ski binding part 5 or to permit attachment and detachment of the same, a locking mechanism 15 is housed in the ski binding part 5. The locking mechanism 15 consists in the present exemplary embodiment of two detents 16, each of which have a locking hook 17, a pushing part 18 and a projection 19. The projections 19 engage adjacent areas of the two detents 16 and serve to guide and hold a pressure spring 20 in place. The pressure spring 20 constantly presses the detents 16 apart so that they desire to assume the position shown in FIG. 4. If the two detents 16 are pressed together by a force applied to the pushing parts 18, as shown in FIG. 3, then the holding arms 11 of the connecting piece 3 can be moved inwardly unhindered or can be pulled unhindered outwardly in the opposite direction. The pressing together of the detents 16 is not absolutely necessary for the connecting piece to move inwardly because the locking hooks 17 have sloped abutting surfaces 21 thereon. As a result, the connecting piece 3 can be moved inwardly and as soon as the locking hooks 17 are in alignment with the recesses 12 on the holding arms 11, engagement occurs automatically.

The axle 4, which serves as the pivot axis for the sole plate 2, has a conventional torsion spring 22 encircling same. The objects and purposes of said spring should be known to the man skilled in the art. Also further parts of the exemplary embodiment according to FIG. 1, as for example structure and operation of the ski binding part 5 are also known.

It will be recognized from FIG. 1 that if the ski boot 7 is held by the holding elements 8,9 on the surface of the sole plate 2 and the sole plate 2 is held with the connecting piece 3 on the ski binding part 5, then the possibility for cross-country skiing is assured by the axle 4. The sole plate 2 can thereby be designed as a common sole plate, as this is illustrated with the support on the ment of said sole plate upwardly with respect to said connecting piece and about said axle and second releasable locking means on said connecting piece and on said toe ski binding member separate from said first releasable locking means for permitting said sole plate and the connected connecting piece to be selectively connected to said toe ski binding member without necessitating a movement of said toe ski binding member and to be replaced with a sole plate adapted for use in downhill skiing.

2. The improved attachment according to claim 1, wherein said connecting piece has two lateral arms thereon each with recesses therein, said arms extending forwardly from the toe of said ski boot in said longitudinal direction of said ski, and one upwardly projecting flange extending transversely of said ski and having fourth means defining an opening therein, and wherein said recesses receive said second releasable locking means on said toe ski binding member therein, and wherein said first releasable locking means includes a pistonlike part, said opening in said flange receiving said pistonlike part on said toe ski binding member therein to effect a securement of said connecting piece to said toe ski binding member.

3. The improved attachment according to claim 2, wherein said second releasable means includes two detents which each have one locking hook and a pushing part in outwardly extending areas thereof, wherein said locking hooks engage said recesses of said lateral arms and carry at each of their adjacent inner ends one holding pin on which is arranged a pressure spring which constantly urges the detents into the engaging position.

4. The improved attachment according to claim 1, wherein said connecting piece has two holding arms thereon supporting said axle and a forwardly extending tab having a notch therein and wherein said tab is connected through a connecting bar to said holding arms, wherein said connecting bar in its transition area to said tab engages support surfaces of a base plate of said toe ski binding member.

5. The improved attachment according to claim 4, wherein said second releasable locking means includes a slide member which in cross section has a Z-shaped profile and grips over said tab and has an upwardly projecting operating lever, and wherein the side of said Z-shaped profile which is remote from said operating lever has a spring which biasses the slide member to urge a locking nose formed of said Z-shaped profile into the notch of said tab.

6. The improved attachment according to claim 1, wherein said second releasable locking means includes at least two cooperating locking parts, one of said locking parts having a sloped abutting surface for facilitating ease in attachment and detachment of said one locking part to the other of said locking parts.

7. The improved attachment according to claim 6, wherein said one locking part is provided on said connecting piece and wherein said sloped abutment surface faces frontwardly of said connecting piece.

8. The improved attachment according to claim 1, wherein said first releasable locking means includes an elongated pistonlike holding part and wherein said second releasable locking means is located beneath said pistonlike holding part.

* * * * *